US009700169B2

(12) United States Patent
Wong

(10) Patent No.: US 9,700,169 B2
(45) Date of Patent: Jul. 11, 2017

(54) MODULARIZED ARTIFICIAL LIGHT TREE

(71) Applicant: Greenfields Christmas Tree Manufactory, Kowloon (HK)

(72) Inventor: Tony Yat Wah Wong, Kowloon (HK)

(73) Assignee: Greenfields Christmas Tree Manufactory, Kowloon (HK)

( * ) Notice: Subject to any disclaimer, the term of this patent is extended or adjusted under 35 U.S.C. 154(b) by 98 days.

(21) Appl. No.: 14/701,253

(22) Filed: Apr. 30, 2015

(65) Prior Publication Data

US 2016/0081508 A1 Mar. 24, 2016

(30) Foreign Application Priority Data

Sep. 18, 2014 (CN) ..... 2014 2 0538665 U

(51) Int. Cl.

| | |
|---|---|
| ***F21S 4/00*** | (2016.01) |
| ***A47G 33/06*** | (2006.01) |
| ***F21V 23/06*** | (2006.01) |
| ***H01R 27/02*** | (2006.01) |
| *F21W 121/04* | (2006.01) |
| *F21S 4/10* | (2016.01) |

(Continued)

(52) U.S. Cl.

CPC ..... *A47G 33/06* (2013.01); *F21S 4/001* (2013.01); *F21V 23/06* (2013.01); *A47G 2200/08* (2013.01); *F21S 4/10* (2016.01); *F21S 4/20* (2016.01); *F21W 2121/04* (2013.01); *H01R 13/516* (2013.01); *H01R 13/6392* (2013.01); *H01R 24/20* (2013.01); *H01R 24/28* (2013.01)

(58) Field of Classification Search

CPC ..... A47G 33/06; A47G 2200/08; F21S 4/10; F21S 4/20; F21S 4/28; H01R 13/516; H01R 13/6392; H01R 24/20; H01R 24/28; F21W 2121/04; F21V 23/06

USPC ..... 439/502, 505; 362/123

See application file for complete search history.

(56) References Cited

U.S. PATENT DOCUMENTS 2,047,045 A * 7/1936 Veenboer ..... F21S 4/10 362/123

2,533,222 A * 12/1950 Cohen ..... F21S 4/10 362/123

(Continued)

*Primary Examiner* — Alan Cariaso

(74) *Attorney, Agent, or Firm* — Muncy, Geissler, Olds & Lowe, P.C.

(57) ABSTRACT

The utility model belongs to the technical field of Christmas trees and particularly relates to a modularized artificial light tree. The present utility model aims to solve the technical problem about providing the artificial light tree which is convenient to use and maintain and on which the adjacent simulative boles are supplied with the power together. In order to solve the aforementioned problem, the present modularized artificial light tree at least comprises a first simulative bole and a second simulative bole, the top of the outer wall of the first simulative bole is fixedly connected with an electric socket I, and the bottom of the outer wall of the second simulative bole is provided with an electric plug II matched with the electric socket I and is fixedly connected with the electric plug II. The electric socket I and the electric plug II are supplied with the power together. The modularized artificial light tree has the advantages of convenience in use and maintenance and that the two adjacent simulative boles can be supplied with the power together and string lights can be conveniently replaced.

4 Claims, 7 Drawing Sheets

(51) Int. Cl.

| | |
|---|---|
| *F21S 4/20* | (2016.01) |
| *H01R 13/516* | (2006.01) |
| *H01R 13/639* | (2006.01) |
| *H01R 24/20* | (2011.01) |
| *H01R 24/28* | (2011.01) |

(56) References Cited

U.S. PATENT DOCUMENTS

| | | | | | |
|---|---|---|---|---|---|
| 2,572,382 | A * | 10/1951 | Peterson | F21S 4/10 | 362/396 |
| 3,752,407 | A * | 8/1973 | Baugh | F21S 4/10 | 362/123 |
| 4,516,193 | A * | 5/1985 | Murphy | F21V 21/088 | 362/123 |
| 5,245,519 | A * | 9/1993 | Openiano | F21S 4/10 | 362/249.01 |
| 5,422,801 | A * | 6/1995 | Sangalli, Jr. | F21S 4/10 | 362/123 |
| 5,855,705 | A * | 1/1999 | Gauthier | F21S 4/10 | 156/61 |
| 6,883,951 | B2 * | 4/2005 | Wu | A47G 33/06 | 362/123 |
| 8,876,321 | B2 * | 11/2014 | Chen | F21V 33/00 | 362/123 |
| 9,431,765 | B2 * | 8/2016 | Tao | H01R 13/24 | |

* cited by examiner

MODULARIZED ARTIFICIAL LIGHT TREE

TECHNICAL FIELD

The utility model belongs to the technical field of Christmas trees and particularly relates to a modularized artificial light tree.

BACKGROUND

During the Christmas season, people are used to bringing the Christmas trees into their homes or shopping centers, decorating them with strings of lights and ornaments. However, to decorate a real pine causes quite a lot of trouble, so for convenience, people prefer an artificial pine, and manufacturers always tie strings of lights in the artificial pine boles as ornaments. Mostly, the artificial pine is disassembled into two to four boles so as to be packaged in boxes, each bole has many preinstalled decorative string lights, and electric connectors are usually exposed outside bole leaves. Customers have to assemble the boles and connect the adjacent electric connectors of the decorative lights of each bole so as to power on the lights in the whole tree. While partly due to the redundant string lights of each bole, the customers feel troublesome and take much time to match all the electric connectors of the string lights. Therefore, use is quite inconvenient. What's worse, if the electric connectors are arranged in the boles, it is almost unlikely to maintain the electronic part of the electronic connectors or electric wires in the lights of the boles. For instance, disconnection of only one light circuit or a connector in a metal bole may result in blackout of all the lights in the tree. It is very hard to maintain, or even the entire bole should be partially or integrally replaced.

SUMMARY OF THE UTILITY MODEL

The present utility model aims to solve the technical problem about providing the artificial light tree which is convenient to use and maintain and on which the adjacent simulative boles are supplied with the power simultaneously.

In order to solve the aforementioned problem, the technical scheme includes that:

the present modularized artificial light tree at least comprises a first simulative bole and a second simulative bole, the simulative boles are hollow tube stocks, and the top of the first simulative bole is detachably and fixedly connected with the bottom of the second simulative bole; the top of the outer wall of the first simulative bole is fixedly connected with a first electric socket, and the bottom of the outer wall of the second simulative bole is provided with a first electric plug matched with the first electric socket and is fixedly connected with the first electric plug. The light tree further comprises at least one string light. The tail end of each string light is provided with a second electric plug, the first simulative bole also comprises an electric socket II matched with the second electric plug, and the first electric socket is fixed on the outer wall of the first simulative bole. The first electric socket and the first electric plug are supplied with power together.

Preferably, the light tree further comprises holders, each holder consists of a holding hole and a positioning hole, the holding holes are matched with the electric sockets and the positioning holes are matched with the simulative boles.

Preferably, the top of the first simulative bole is provided with a first groove or a first projection, and the bottom of the second simulative bole is provided with a second projection or a second groove matched with the said groove or projection.

Preferably, if more than two electric sockets and electric plugs are provided, then the electric plugs are staggered.

Preferably, the cross section of the first electric socket and that of the first simulative bole are parallel to each other or arranged on the same plane.

Preferably, the light tree further comprises a third simulative bole, the top of the third simulative bole comprises a third electric socket and at least one electric plug, wherein the third electric socket is connected with the other simulative bole, and the electric plugs are connected with the string lights. The top of the second simulative bole is provided with a fourth electric socket, and the bottom of the third simulative bole is provided with an electric plug matched with the fourth electric socket.

Preferably, the light tree further comprises a shell, and the shell wraps the first electric socket and the first electric plug inside and is provided with corresponding circuit holes.

Preferably, the shell is composed of a left half shell and a right half shell which are detachably and fixedly connected or an upper half shell and a lower half shell which are connected in the same way.

Preferably, each of the left half shell and the right half shell is composed of an upper part and a lower part.

The present utility model has the advantages that the said artificial light tree is convenient to use, the characteristics of the boles can be displayed as long as the simulative boles are sequentially connected, and the string lights can be connected after the electric plugs of the string lights are connected with the electric sockets on the boles; the said artificial light tree is also convenient to maintain as the electric sockets on the boles are independently and intensively set; the two adjacent simulative boles can be supplied with the power at the same time. Taking the first simulative bole as example, the first electric socket and the first electric plug are supplied with the power at the same time, when the first electric plug at the bottom of the outer wall of the second simulative bole is connected with the first electric socket at the top of the first simulative bole, the two adjacent simulative boles can be supplied with the power together; the artificial light tree is low in fault rate by the aid of the shell at the joints of the simulative boles, to be specifically, the shell can prevent the electric sockets from falling off easily, and the fault rate is resultantly lowered.

BRIEF DESCRIPTION OF THE DRAWINGS

The present utility model will be more fully understood from the following description, given by several drawings showing the idea of the present utility model best. Beyond doubt, the accompanying drawings are provided for illustration only, not for stating the whole technical scheme of the utility model and even not for limiting the content of the utility model. It should be understood that any schemes designed under the revelation of the drawings belong to the scope of these claims.

DETAILED DESCRIPTION OF THE EMBODIMENTS

Figure 1:
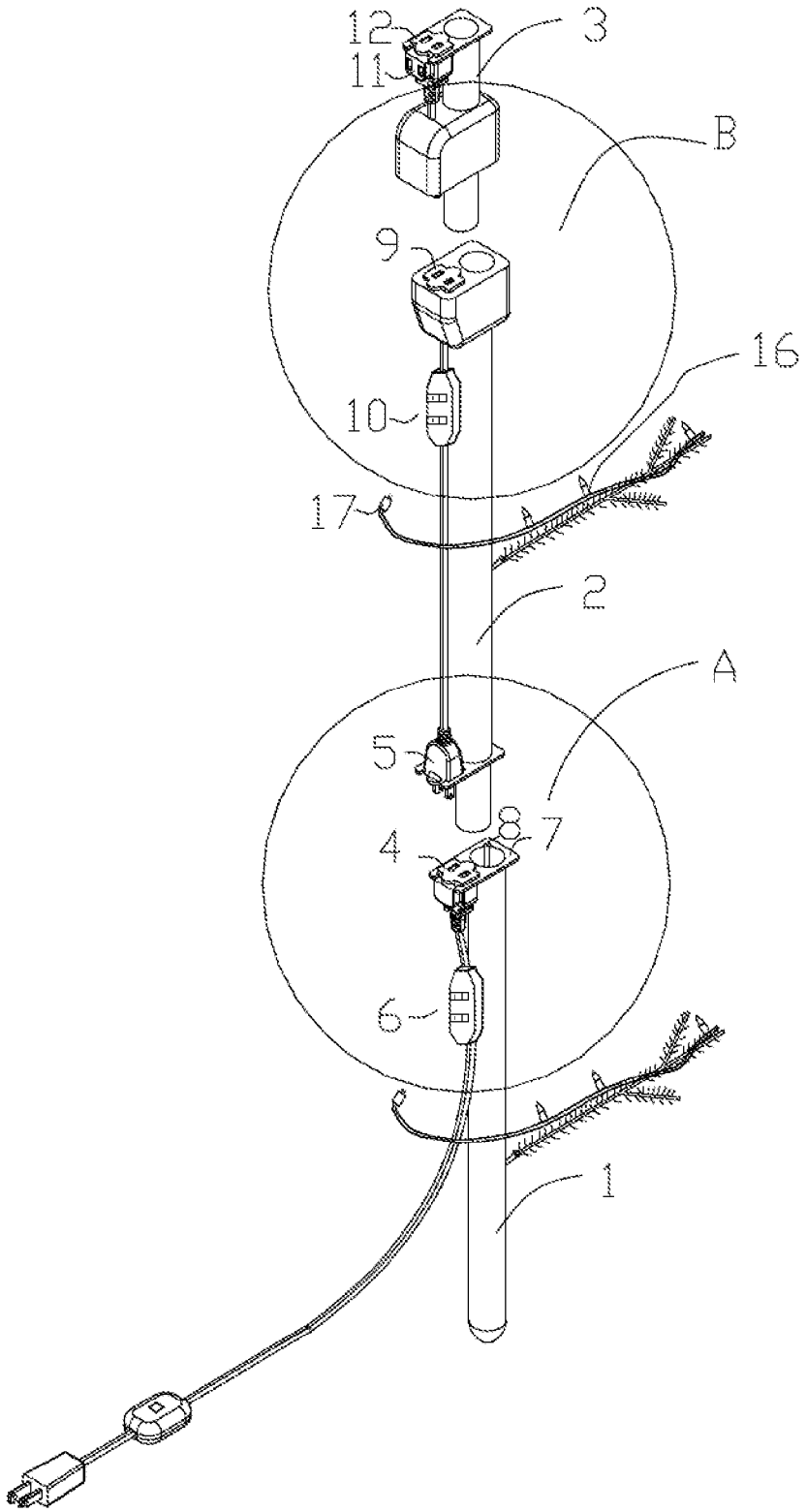
FIG. 1 is a schematic view showing the integral light tree.
Figure 2:
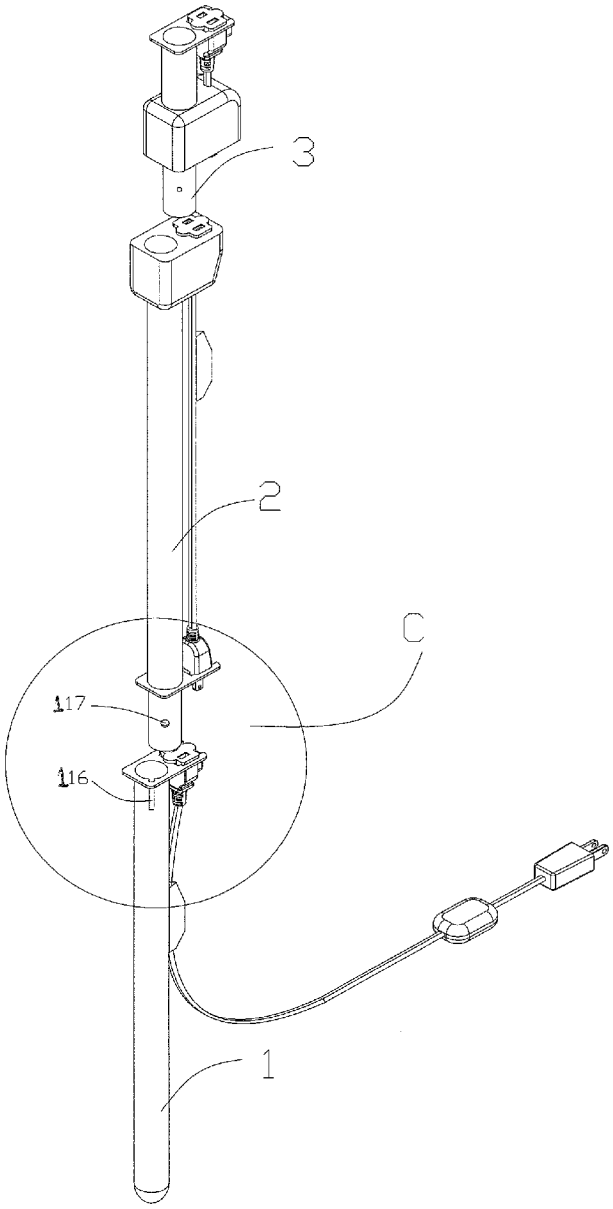
FIG. 2 is an overall schematic view showing the light tree from the other angle.
Figure 3:
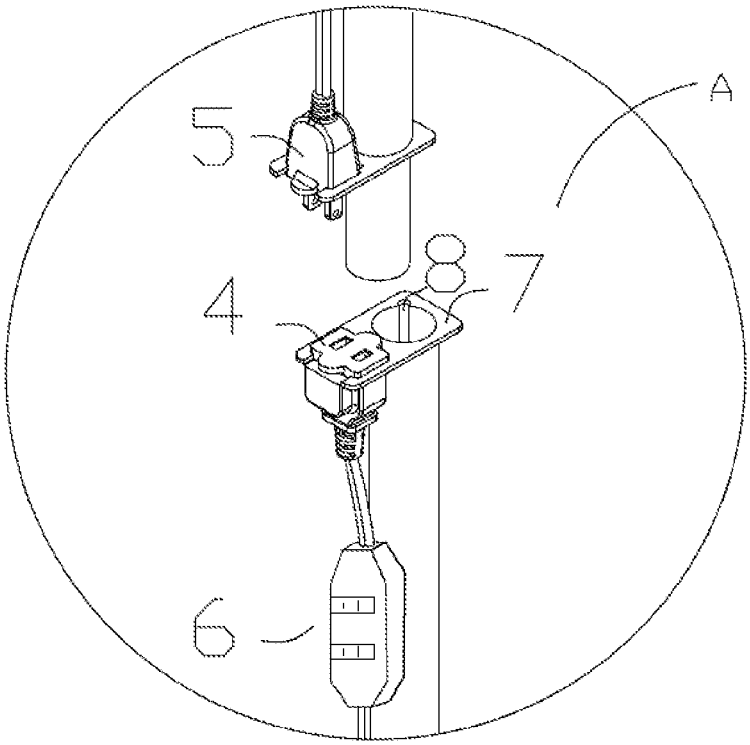
FIG. 3 is an enlarged view of a part A.
Figure 4:
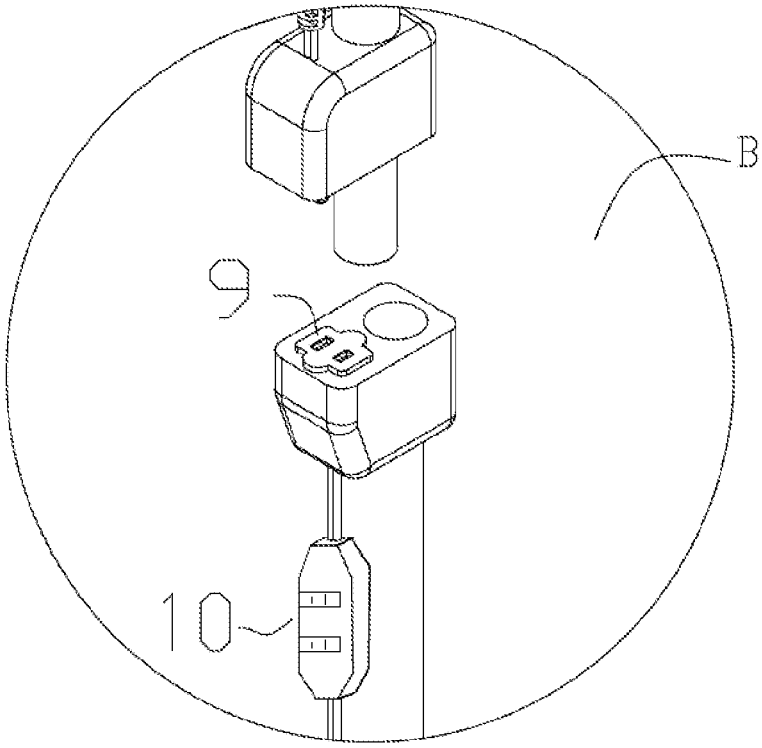
FIG. 4 is an enlarged view of a part B.
Figure 5:
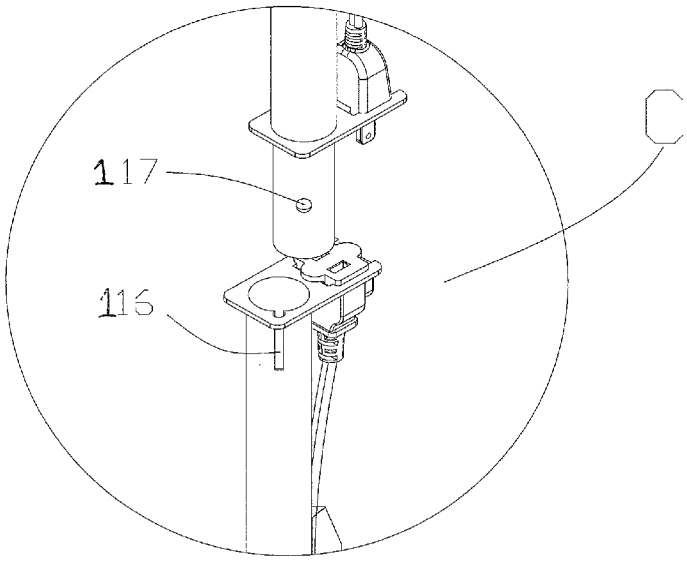
FIG. 5 is an enlarged view of a part C.
Figure 6:
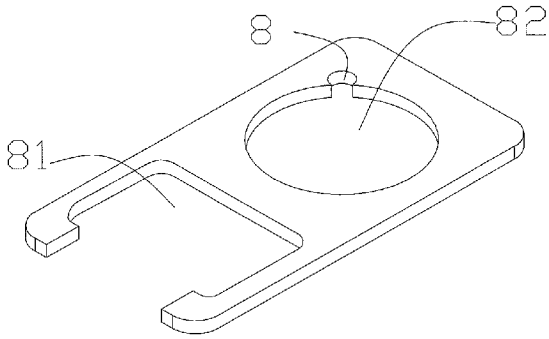
FIG. 6 is a schematic view showing a holder.

The present utility model will be more fully understood from the following description, given by several drawings showing the idea of the present utility model best. Beyond doubt, the accompanying drawings are provided for illustration only, not for stating the entire technical scheme of the utility model and even not for limiting the content of the utility model. It should be understood that any schemes designed under the revelation of the drawings belong to the scope of these claims.

A modularized artificial light tree at least comprises a first simulative bole 1 and a second simulative bole 2, which are hollow tube stocks. The top of the first simulative bole is detachably and fixedly connected with the bottom of the second simulative bole; the top of the outer wall of the first simulative bole is fixedly connected with a first electric socket 4, the bottom of the outer wall of the second simulative bole is provided with a first electric plug 5 matched with the electric socket 4 and is fixedly connected with the electric plug 5. The light tree further comprises at least one string light 16, and the tail end of each string light is provided with a second electric plug 17. The first simulative bole is provided with an electric connector 6 matched with the electric plug 17, and the electric connector 6 is fixed on the outer wall of the first simulative bole. The electric socket 4 and the electric connector 6 are supplied with the power together and can be integrated or be connected via leads.

For more conveniently fixing the electric sockets and connecting the two adjacent simulative boles, the light tree also comprises holders 7, each holder consists of a holding hole 81 and a positioning hole 82, the holding holes are matched with the electric sockets and the positioning holes are matched with the simulative boles.

For conveniently connecting the two adjacent simulative boles, especially the electric sockets, the first simulative bole is provided with the groove or projection at the top, and the second simulative bole is provided with the projection or groove matched with the groove or projection at the bottom. That is, when the first simulative bole is provided with the groove 116 at the top, the second simulative bole is correspondingly provided with the projection 117 matched with the groove and vice versa. When the holders are mounted on the simulative boles and the simulative boles are provided with the grooves at the corresponding positions, the holders are also provided with small grooves 8 or projections correspondingly.

For conveniently connecting the string lights or the electric connectors, at least one electric socket and at least one electric plug are provided.

For better heat radiation and well arrangement of the string lights, the electric plugs are staggered when provided more than two.

For joint connection of the two adjacent simulative boles, the cross section of the electric socket I and that of the first simulative bole are parallel to each other or arranged on the same plane.

Preferably, the light tree comprises a third simulative bole 3, the top of the third simulative bole is provided with an electric socket 12 and at least one electric plug 11, the electric socket 12 is connected with another simulative bole, and the electric plug 11 is connected with the string lights. The second simulative bole is further provided with an electric socket 9 and at least one electric connector 10 at the top so as to be conducive to connection of the string lights. The bottom of the third simulative bole is provided with an electric plug matched with the electric socket 9.

Figure 7:
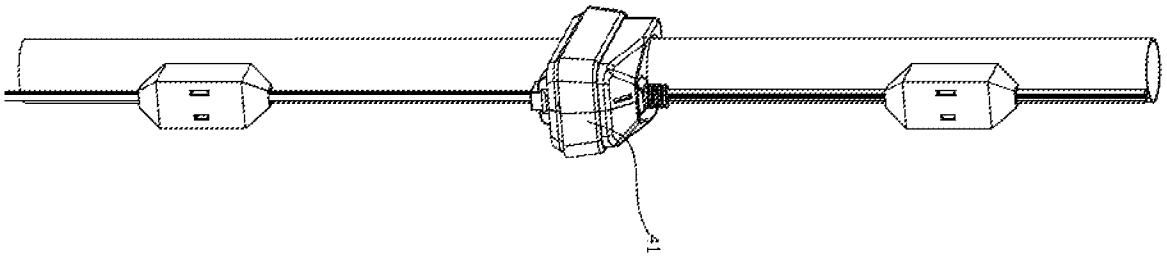
FIG. 7 is a structural schematic view showing the simulative bole of the Christmas tree comprising the shell.

In order to prevent the electric sockets from falling off easily and reduce the fault rate, the light tree further comprises a shell 41, shown as FIG. 7, the shell wraps the electric socket 4 and the electric plug 5 inside and is provided with the corresponding circuit holes.

Figure 8:
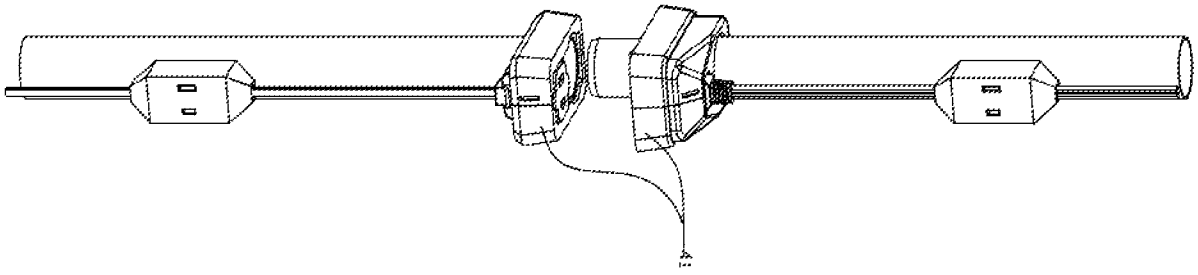
FIG. 8 is a schematic and explosive view showing the simulative bole of the Christmas tree comprising the shell.

In order to being mounted conveniently, the shell is composed of a left half shell and a right half shell which are detachably and fixedly connected or an upper half shell and a lower half shell which are connected in the same way. As FIG. 8, the shell is composed of an upper part and a lower part. The detachable and fixed connection hereby refers to fastening, nesting or nut-bolt connection.

Figure 9:
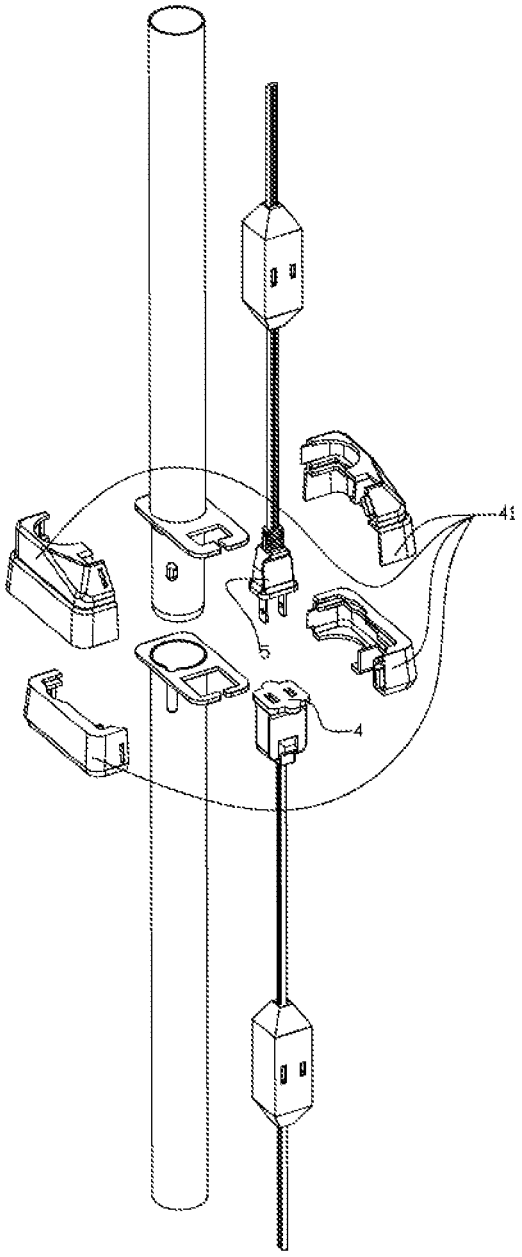
FIG. 9 is an explosive view showing the simulative bole of the Christmas tree comprising the shell.

In order to further facilitate mounting, the left half shell as well as the right half shell consists of an upper part and a lower part. As FIG. 9, the shell is formed by four parts.

The invention claimed is:

1. A modularized artificial light tree, comprising:

a first simulative bole;

a second simulative bole;

a first electric socket;

at least one string light; and a shell including a left half shell and a right half shell which are detachably connected, the left half shell and the right half shell each comprising an upper part and a lower part, wherein both the first simulative bole and the second simulative bole are hollow tube stocks, wherein a top of the first simulative bole is detachably and fixedly connected with a bottom of the second simulative bole, wherein a top of an outer wall of the first simulative bole is fixedly connected with the first electric socket, and a bottom of an outer wall of the second simulative bole is provided with a first electric plug matched with the electric socket and is fixedly connected with the electric plug, wherein a tail end of the at least one string light is provided with a second electric plug, wherein the first simulative bole comprises a second electric socket matched with the second electric plug, wherein the second electric socket is fixed on the outer wall of the first simulative bole, wherein the first electric socket and the first electric plug are supplied with power together, and wherein the shell wraps the first electric socket and the first electric plug inside and is provided with corresponding circuit holes.

2. A light tree as claimed in claim 1, further comprising several holders, each holder comprising a holding hole and a positioning hole, the holding holes being matched with electric connectors, and the positioning holes being matched with the first simulative bole and the second simulative bole.

3. A light tree as claimed in claim 1, wherein a cross section of the first electric socket and a cross section of the first simulative bole are parallel to each other or arranged on the same plane.

4. A light tree as claimed in claim 1, further comprising a third simulative bole, a top of the third simulative bole comprising a third electric socket connected with the first simulative bole or the second simulative bole and a third electric plug connected with the at least one string light, wherein the top of the second simulative bole further comprises a fourth electric socket, and a bottom of the third simulative bole comprises a fourth electric plug matched with the fourth electric socket.

* * * * *